US011578844B2

(12) United States Patent
Peng

(10) Patent No.: US 11,578,844 B2
(45) Date of Patent: Feb. 14, 2023

(54) LIGHT-EMITTING DIODE LIGHT STRING CONTROL SYSTEM WITH CARRIER IDENTIFICATION FUNCTION AND SIGNAL IDENTIFICATION METHOD THEREOF

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 16 days.

(21) Appl. No.: 17/219,288

(22) Filed: Mar. 31, 2021

(65) Prior Publication Data

US 2022/0316665 A1 Oct. 6, 2022

(51) Int. Cl.

| | |
|---|---|
| ***F21S 4/26*** | (2016.01) |
| ***H05B 45/37*** | (2020.01) |
| ***H05B 47/185*** | (2020.01) |
| *F21Y 115/10* | (2016.01) |

(52) U.S. Cl.

CPC ..... *F21S 4/26* (2016.01); *H05B 45/37* (2020.01); *H05B 47/185* (2020.01); *F21Y 2115/10* (2016.08)

(58) Field of Classification Search

CPC ..... F21S 4/26; H05B 45/37; H05B 45/185; H05B 47/185

See application file for complete search history.

(56) References Cited

U.S. PATENT DOCUMENTS

2010/0013396 A1* 1/2010 Peng ..... H05B 47/185 315/192
2020/0059999 A1* 2/2020 Pishdadian, Jr. ..... H05B 47/18

FOREIGN PATENT DOCUMENTS

CN 108541111 A 9/2018
TW 202042592 A 11/2020

* cited by examiner

*Primary Examiner* — Diane I Lee
*Assistant Examiner* — Nathaniel J Lee
(74) *Attorney, Agent, or Firm* — Muncy, Geissler, Olds & Lowe, P.C.

(57) ABSTRACT

A light-emitting diode (LED) light string control system with carrier identification function includes a control module, a power capacitor, and an LED light string. The control module converts a DC voltage to carry signals on the DC voltage through a power switch according to a lighting command. The power capacitor performs a capacitive charge-discharge operation to the signals on the DC voltage to generate capacitive charge-discharge signals. The LED light string includes at least one LED module, and the at least one LED module identifies that a charge-discharge characteristic is a first logic, a second logic, or a latch indication, and to generate a drive command corresponding to the signals on the DC voltage according to one of the first logic, the second logic, and the latch identification to control lighting behavior of the LED light string.

10 Claims, 5 Drawing Sheets

LIGHT-EMITTING DIODE LIGHT STRING CONTROL SYSTEM WITH CARRIER IDENTIFICATION FUNCTION AND SIGNAL IDENTIFICATION METHOD THEREOF

BACKGROUND

Technical Field

The present disclosure relates to a light-emitting diode light string control system and a signal identification method thereof, and more particularly to a light-emitting diode light string control system with carrier identification function and a signal identification method thereof.

Description of Related Art

The statements in this section merely provide background information related to the present disclosure and do not necessarily constitute prior art.

As the applications of light-emitting diodes (LEDs) are becoming more and more popular, and their manufacturing costs are getting lower and lower, the applications of LEDs in lighting or display are becoming more and more widespread. Therefore, there are more and more manners to operate and control lighting behavior of LEDs. In the applications of the LED light string, since it is necessary to set lighting behavior of each LED, the LED light string can produce a visual effect. Accordingly, a controller should be used to control each LED, and each controller also has the function of identifying signals so as to be able to determine whether the signals are specific lighting commands.

Since most of the carrier signals, which are signals carried on a DC voltage, received by the existing LED light strings are high-power and high-frequency switching signals, it is easy to affect the stability of signal identification due to the interference of high-frequency noise of the switching signal. At this condition, it is necessary to use a relatively high-precision identification circuit or circuit components that are more resistant to noise interference to increase the stability of signal identification. However, such high-precision identification circuits or circuit components are usually expensive and their operation manners are also complicated.

Therefore, an LED light string control system with carrier identification function and a signal identification method thereof are provided to accurately identify the signals on the DC voltage and correctly perform the lighting behavior of the LED light string.

SUMMARY

In order to solve the above-mentioned problems, an LED light string control system with carrier identification function is provided. The LED light string control system with carrier identification function includes a control module, a power capacitor, and an LED light string. The control module converts a DC voltage to carry signals on the DC voltage through a power switch according to a lighting command. The power capacitor is coupled to an output end of the control module, and performs a capacitive charge-discharge operation to the signals on the DC voltage to generate capacitive charge-discharge signals. The LED light string includes at least one LED module and is coupled to the power capacitor. The at least one LED module identifies that a charge-discharge characteristic is to a first logic, a second logic, or a latch indication, and generates a drive command corresponding to the signals on the DC voltage according to one of the first logic, the second logic, and the latch identification to control lighting behavior of the LED light string.

In order to solve the above-mentioned problems, a signal identification method of an LED light string control system is provided. The signal identification method includes steps of: converting a DC voltage to carry signals on the DC voltage according to a lighting command, performing a capacitive charge-discharge operation to the signals on the DC voltage to generate capacitive charge-discharge signals, identifying a charge-discharge characteristic of the capacitive charge-discharge signals being a first logic, a second logic, or a latch indication, and generating a drive command corresponding to the signals on the DC voltage according to the first logic, the second logic, and the latch indication to control lighting behavior of an LED light string.

The main purpose and effect of the present disclosure are that the power capacitor performs the capacitive charge-discharge operation to the signals on the DC voltage to generate the capacitive charge-discharge signals and the LED module identifies the charge-discharge characteristic of the capacitive charge-discharge signals so that the circuit components are simple, the operation is easy, and the signals on the DC voltage can be accurately identified and the lighting behavior can be correctly performed.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The present disclosure can be more fully understood by reading the following detailed description of the embodiment, with reference made to the accompanying drawing as follows.

DETAILED DESCRIPTION

Figure 1:
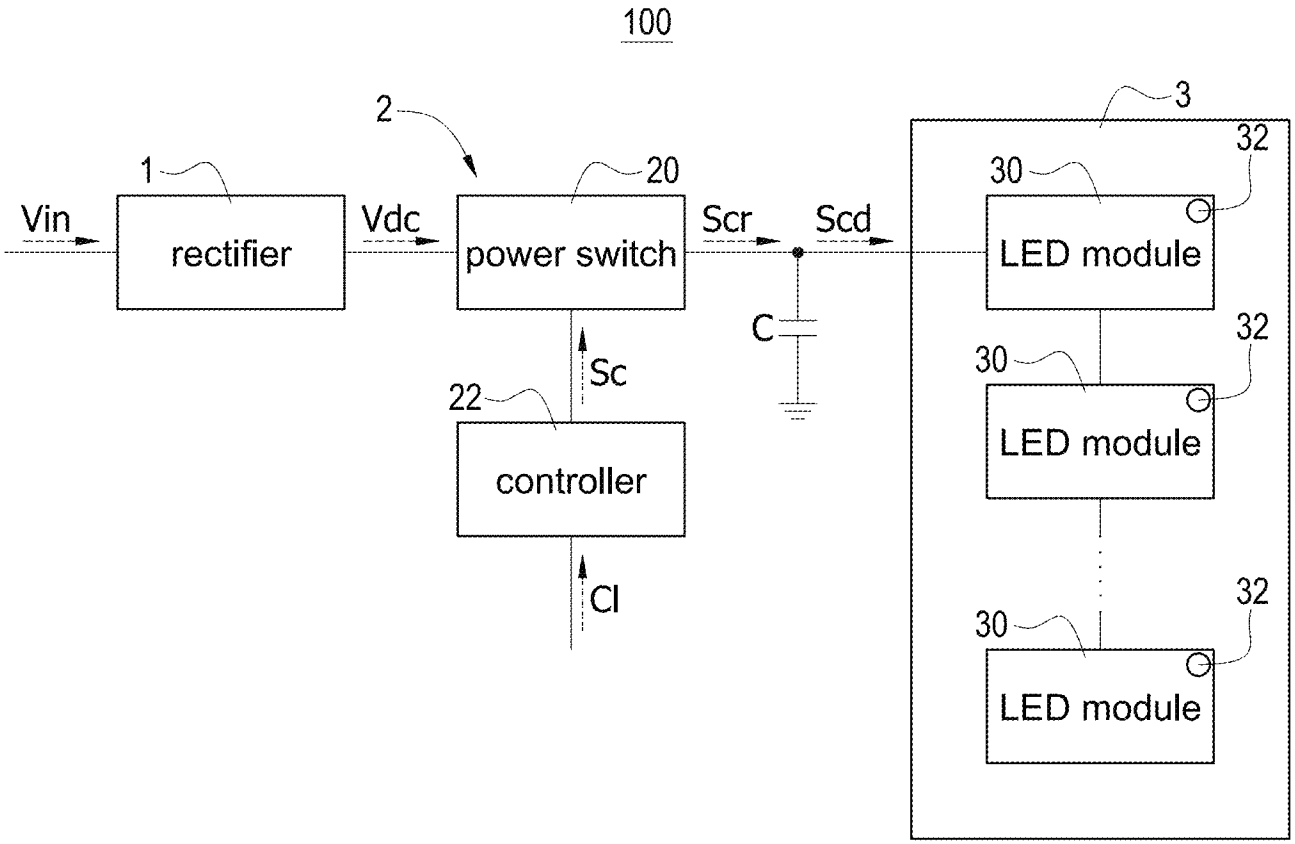
FIG. 1 is a block circuit diagram of a light-emitting diode (LED) light string control system with carrier identification function according to the present disclosure.

Reference will now be made to the drawing figures to describe the present disclosure in detail. It will be understood that the drawing figures and exemplified embodiments of present disclosure are not limited to the details thereof.

Please refer to FIG. 1, which shows a block circuit diagram of a light-emitting diode (LED) light string control system with carrier identification function according to the present disclosure. The LED light string control system 100 receives an input voltage Vin through an input end. The LED light string control system 100 includes a rectifier 1, a control module 2, a power capacitor C, and an LED light string 3. The control module 2 is coupled to the rectifier 1 and the LED light string 3. The power capacitor C is coupled between the control module 2 and the LED light string 3. The rectifier 1 rectifies an AC input voltage Vin into a DC voltage Vdc. The control module 2 converts (switches) the DC voltage Vdc to carry signals on the DC voltage (hereinafter referred to as carrier signals Scr) according to a lighting command C1 externally provided. The power capacitor C is coupled to an output end of the control module 2, and performs a capacitive charge-discharge operation to the carrier signals Scr to generate capacitive charge-discharge signals Scd. The LED light string 3 is coupled to the power capacitor C, and the LED light string 3 includes at least one LED module 30. The LED module 30 includes at least one LED 32, and the carrier signals Scr are provided to control lighting behavior of the at least one LED 32 of the LED light string 3. When the at least one LED module 30 is plural in this embodiment, these LED modules 30 may be coupled in series (shown in FIG. 1) or coupled in parallel (not shown). In one embodiment, the LED light string control system 100 may not include the rectifier 1, that is, the LED light string control system 100 directly receives the DC voltage Vdc as the input voltage. Alternatively, the rectifier 1 may be replaced by a DC converter, and the DC converter receives a DC input voltage Vin and converts the input voltage Vin into the DC voltage Vdc.

The control module 2 includes a power switch 20 and a controller 22. The power switch 20 is coupled between the rectifier 1 and the power capacitor C. The controller 22 is coupled a control end of the power switch 20, and provides a control signal Sc to control turning on and turning off the power switch 20 according to the lighting command C1 so as to convert (switch) the DC voltage Vdc to carry signals on the DC voltage (i.e., the carrier signals Scr) by turning on and turning off the power switch 20. In particular, the controller 22 may not include a traditional lighting signal generator, and generates the carrier signals Scr with changes in high-level voltage and low-level voltage by controlling turning on or turning off the power switch 20.

Since the carrier signals Scr are mostly composed of pulses with different widths, the width represents a specific logic meaning. Since the pulses with different widths are affected by the charging and discharging of the power capacitor C to generate different charge-discharge characteristics, the LED module 30 is designed to identify the charge-discharge characteristic of the capacitive charge-discharge signals Scd is a first logic (for example but not limited to logic "0"), a second logic (for example but not limited to logic "1"), or a latch indication (which is usually at the end of a pulse for indicating that the LED module 30 can perform a latch operation). Therefore, the drive command corresponding to the carrier signals Scr is generated according to the first logic, the second logic, and the latch indication to control lighting behavior of the LED 32 of the LED module 30. In particular, the drive command includes at least one of an address data and a lighting data. The address data and the lighting data may be selectively cooperated according to actual needs, for example, only the lighting data is provided or both the address data and the lighting data are provided.

The address data designates to at least one LED module 30. When the at least one LED module 30 is singular, the address data designates to the only LED module 30. When the at least one LED module 30 is plural, the address data may designate to one or more of the LED modules 30. The lighting data designates to the lighting behavior of the at least one LED module 30. When the at least one LED module 30 is singular, the lighting data designates to the lighting behavior of the only LED module 30. When the at least one LED module 30 is plural, the lighting data designates to the lighting behavior of one or more of the LED modules 30.

Figure 2:
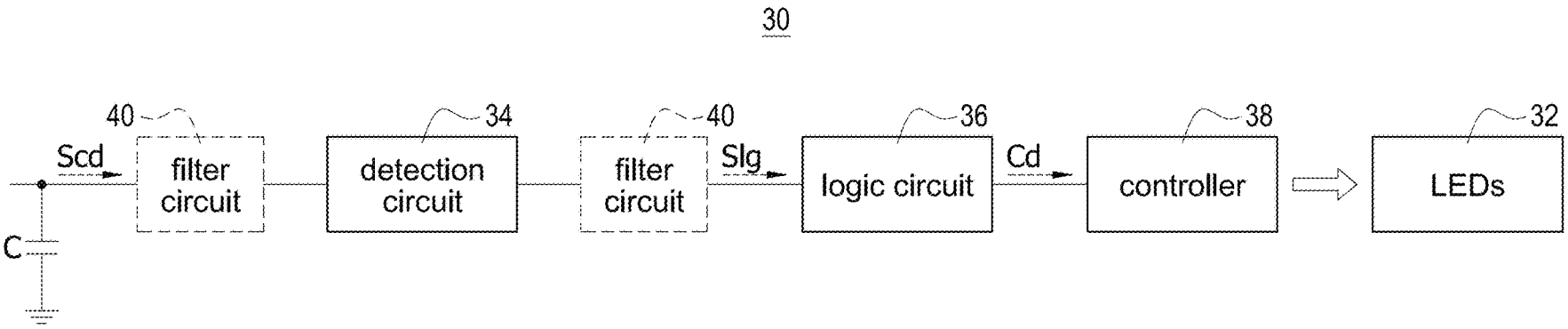
FIG. 2 is a block circuit diagram of an LED module according to the present disclosure.

Please refer to FIG. 2, which shows a block circuit diagram of an LED module according to the present disclosure, and also refer to FIG. 1. Besides the at least one LED 32, the LED module 30 further includes a detection circuit 34, a logic circuit 36, and a controller 38. The detection circuit 34 is coupled to the power capacitor C, and detects the capacitive charge-discharge signals Scd and generates a logic signal Slg according to a charge-discharge characteristic of the capacitive charge-discharge signals Scd. The logic circuit 36 is coupled to the detection circuit 34, and identifies that the logic signal Slg is a first logic, a second logic, or a latch indication to correspondingly generate a drive command Cd. In particular, the logic signal Slg may include multiple logic combinations (such as but not limited to "1011"). When identifying the logic signal Slg as "1011", the logic circuit 36 generates the drive command Cd according to the logic combinations of the logic signal Slg. The controller 38 is coupled to the logic circuit 36 and the LED 32, and receives the drive command Cd and stores the drive command Cd in a memory unit (not shown) inside the controller 38. Therefore, the controller 38 controls lighting behavior of the LED 32 according to the drive command Cd. When the at least one LED module 30 is plural, since the drive command Cd of each LED module 30 may be different, the overall lighting behavior of the LED light string 3 may change, such as but not limited to sequential lighting, sequential blinking, and so on.

Moreover, the LED module 30 includes at least two manners for identifying the charge-discharge characteristic. The first one is that the LED module 30 uses a predetermined threshold to identify the charge-discharge characteristic, and the second one is that the LED module 30 uses a time width to identify the charge-discharge characteristic. For identifying the charge-discharge characteristic by the predetermined threshold, the detection circuit 34 is used to compare the capacitive charge-discharge signals Scd with the predetermined threshold. Specifically, the detection circuit 34 sets a first threshold, a second threshold, and a third threshold, and the first threshold is the largest one and the third threshold is the smallest one. When a voltage value of the capacitive charge-discharge signals Scd triggers the first threshold, the second threshold, and the third threshold, the detection circuit 34 correspondingly generates a first logic signal, a second logic signal, and a third logic signal (the logic signals belong to the logic signal Slg). The logic circuit 36 identifies that the logic signal Slg is the first logic, the second logic, or the latch indication according to the first logic signal, the second logic signal, and the third logic signal. For example, when the first logic signal, the second logic signal, and the third logic signal appear in sequence within a certain time, it can be determined that the capacitive charge-discharge signals Scd refer to the latch indication (and so on).

For identifying the charge-discharge characteristic by the time width, the detection circuit 34 is used to generate charge time width and discharge time width of charging and discharging the capacitive charge-discharge signals Scd to the same voltage level. Specifically, the detection circuit 34 sets a predetermined threshold, and correspondingly generates the logic signal Slg when the capacitive charge-discharge signals Scd are discharged to be less than or equal to the predetermined threshold and the capacitive charge-discharge signals Scd are charged to be greater than or equal to the predetermined threshold. The logic circuit 36 identifies that the logic signal Slg is the first logic, the second logic, or the latch indication according to the time width of the logic signal Slg. For example, with the longest time width, it may be determined that the capacitive charge-discharge signals Scd refer to the latch indication (and so on).

Please refer to FIG. 2 again, each LED module 30 further includes a filter circuit 40. If an analog filtering approach is used, the filter circuit 40 is coupled between the detection circuit 34 and the power capacitor C. If a digital filtering approach is used, the filter circuit 40 is coupled between the detection circuit 34 and the logic circuit 36. The two embodiments are represented by dashed lines in FIG. 2. The filter circuit 40 is used to filter noise of the capacitive charge-discharge signals Scd. Specifically, since the capacitive charge-discharge signals Scd are a high-power signal and the power switch 20 is switched at a high frequency, the capacitive charge-discharge signals Scd produce more rough edges or switching surges, and the rough edges or switching surges will affect the detection accuracy of the capacitive charge-discharge signals Scd by the detection circuit 34. Therefore, using the filter circuit 40 to filter noise of the capacitive charge-discharge signals Scd is a preferred embodiment of the LED light string control system 100.

Figure 3A:
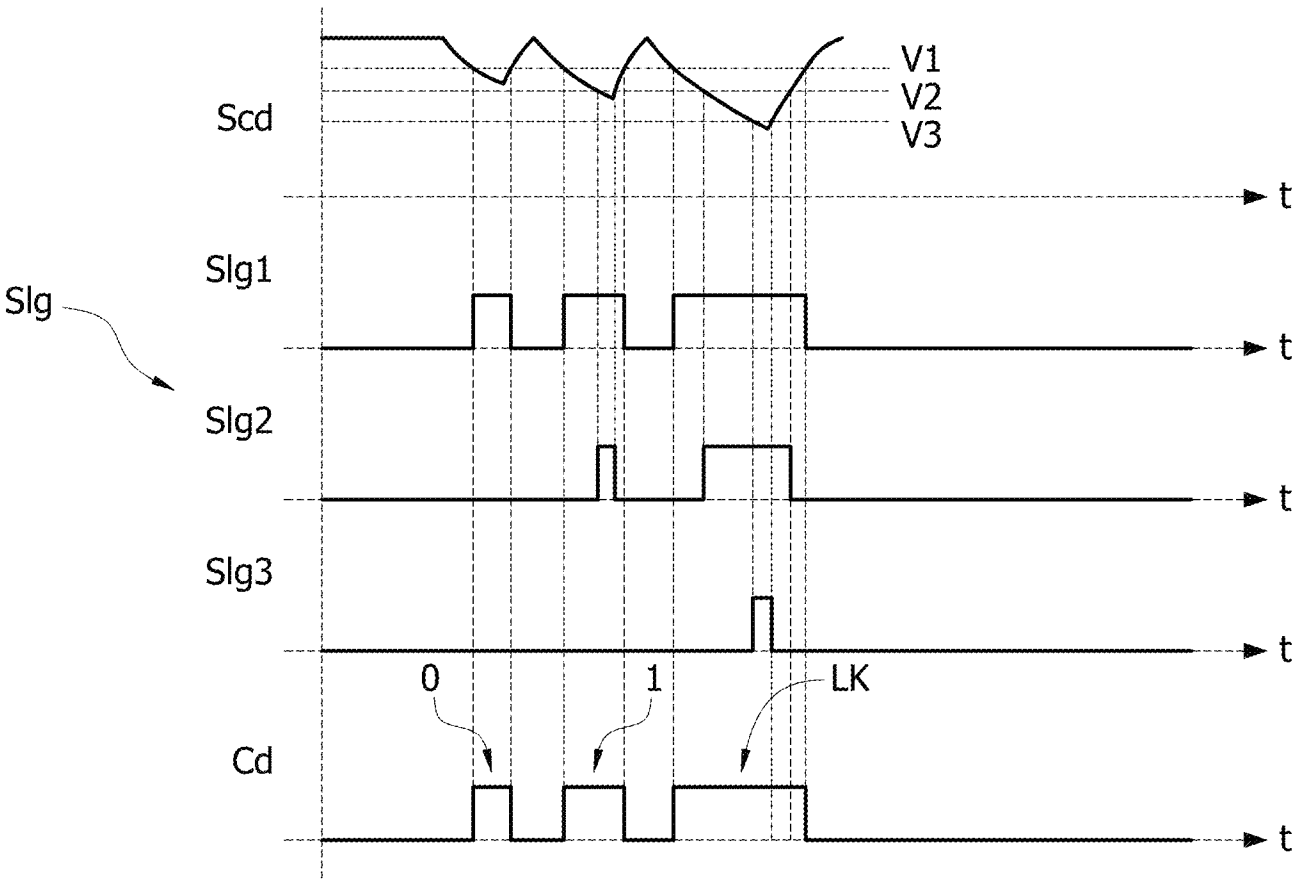
FIG. 3A is a waveform diagram of identifying a charge-discharge characteristic by a predetermined threshold according to the present disclosure.

Please refer to FIG. 3A, which shows a waveform diagram of identifying a charge-discharge characteristic by a predetermined threshold according to the present disclosure, and also refer to FIG. 1 and FIG. 2. In FIG. 3A, Scd are the capacitive charge-discharge signals, V1, V2, and V3 are respectively the first threshold, the second threshold, and the third threshold, Slg is the logic signal, Slg1, Slg2, and Slg3 are respectively the first logic signal, the second logic signal, and the third logic signal, Cd is the drive command, and "0", "1", "LK" are respectively the first logic, the second logic, and the latch indication. When the voltage value of the capacitive charge-discharge signals Scd is respectively less than the first threshold V1, the second threshold V2, and the third threshold V3, the detection circuit 34 correspondingly generates the first logic signal Slg1, the second logic signal Slg2, and the third logic signal Slg3. The logic circuit 36 generates the first logic "0" based on the logic signal Slg having only the first logic signal Slg1, the logic circuit 36 generates the second logic "1" based on the logic signal Slg having the first logic signal Slg1 and the second logic signal Slg2, and the logic circuit 36 generates the latch indication "LK" based on the logic signal Slg having the first logic signal Slg1, the second logic signal Slg2, and the third logic signal Slg3. The controller 38 gets the permutation and combination of logic "0" and logic "1" to be the drive command Cd and stores the drive command Cd in the memory unit (not shown) inside the controller 38. Therefore, the carrier signals Scr can be accurately identified and the lighting behavior can be correctly performed.

In one embodiment, the manner of identifying the charge-discharge characteristic by the predetermined threshold is not limited to the above-mentioned examples. Any manner of identifying the charge-discharge characteristic by the predetermined threshold should be included in the scope of the present disclosure. In addition, the time widths corresponding to the logic "0" and the logic "1" may also be swapped with each other. For example, the logic circuit 36 generates the first logic "1" but not limited to the logic "0" according to the logic signal Slg having only the first logic signal Slg1. In one embodiment, the latch indication "LK" may express that the capacitive charge-discharge signals Scd having longer discharging time or express that the capacitive charge-discharge signals Scd having longer high-level time.

Figure 3B:
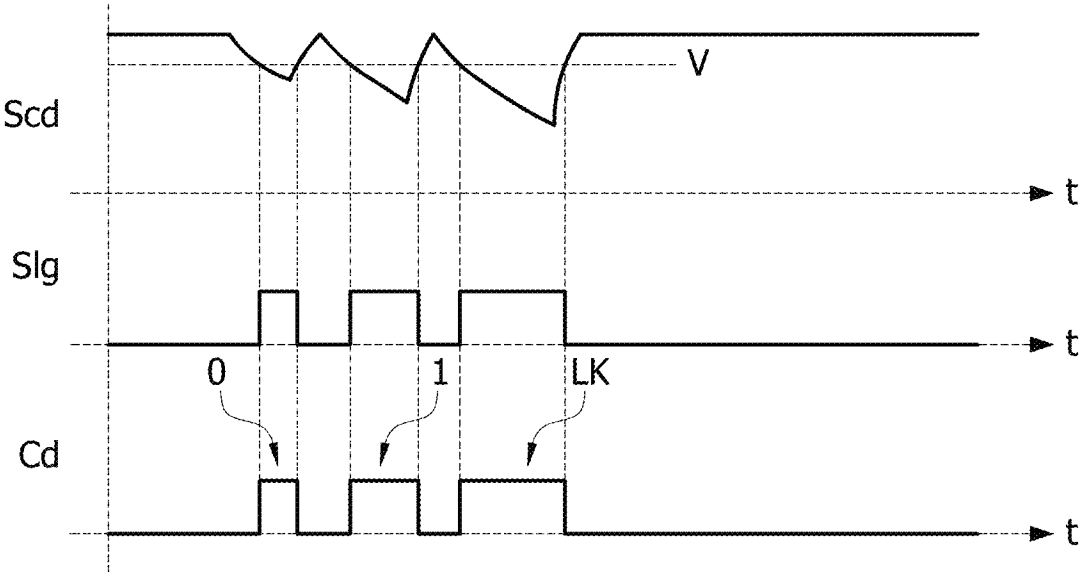
FIG. 3B is a waveform diagram of identifying the charge-discharge characteristic by a time width according to the present disclosure.

Please refer to FIG. 3B, which shows a waveform diagram of identifying the charge-discharge characteristic by the time width according to the present disclosure, and also refer to FIG. 1 to FIG. 3A. In FIG. 3B, Scd are the capacitive charge-discharge signals, V is the predetermined threshold, Slg is the logic signal, Cd is the drive command, and "0", "1", "LK" are respectively the first logic, the second logic, and the latch indication. When the capacitive charge-discharge signals Scd are discharged to be less than or equal to the predetermined threshold V, the logic signal Slg changes to the first voltage level H (i.e., a high level), and when the capacitive charge-discharge signals Scd are charged to be greater than or equal to the predetermined threshold V, the logic signal Slg changes to the second voltage level L (i.e., a low level). The logic circuit 36 identifies that the logic signal Slg is the first logic "0", the second logic "1", or the latch indication "LK" according to the time width of the logic signal Slg at the first voltage level. When the time width of the logic signal Slg at the first voltage level is shorter, the first logic "0" is determined. When the time width of the logic signal Slg at the first voltage level is longer, the second logic "1" is determined. When the time width of the logic signal Slg at the first voltage level is the longest, the latch indication "LK" is determined. The controller 38 gets the permutation and combination of logic "0" and logic "1" to be the drive command Cd and stores the drive command Cd in the memory unit (not shown) inside the controller 38. Therefore, the carrier signals Scr can be accurately identified and the lighting behavior can be correctly performed.

In one embodiment, the manner of identifying the charge-discharge characteristic by the time width is not limited to the above-mentioned examples. Any manner of identifying the charge-discharge characteristic by the time width should be included in the scope of the present disclosure. In addition, the time widths corresponding to the logic "0" and the logic "1" may also be swapped with each other.

Figure 4:
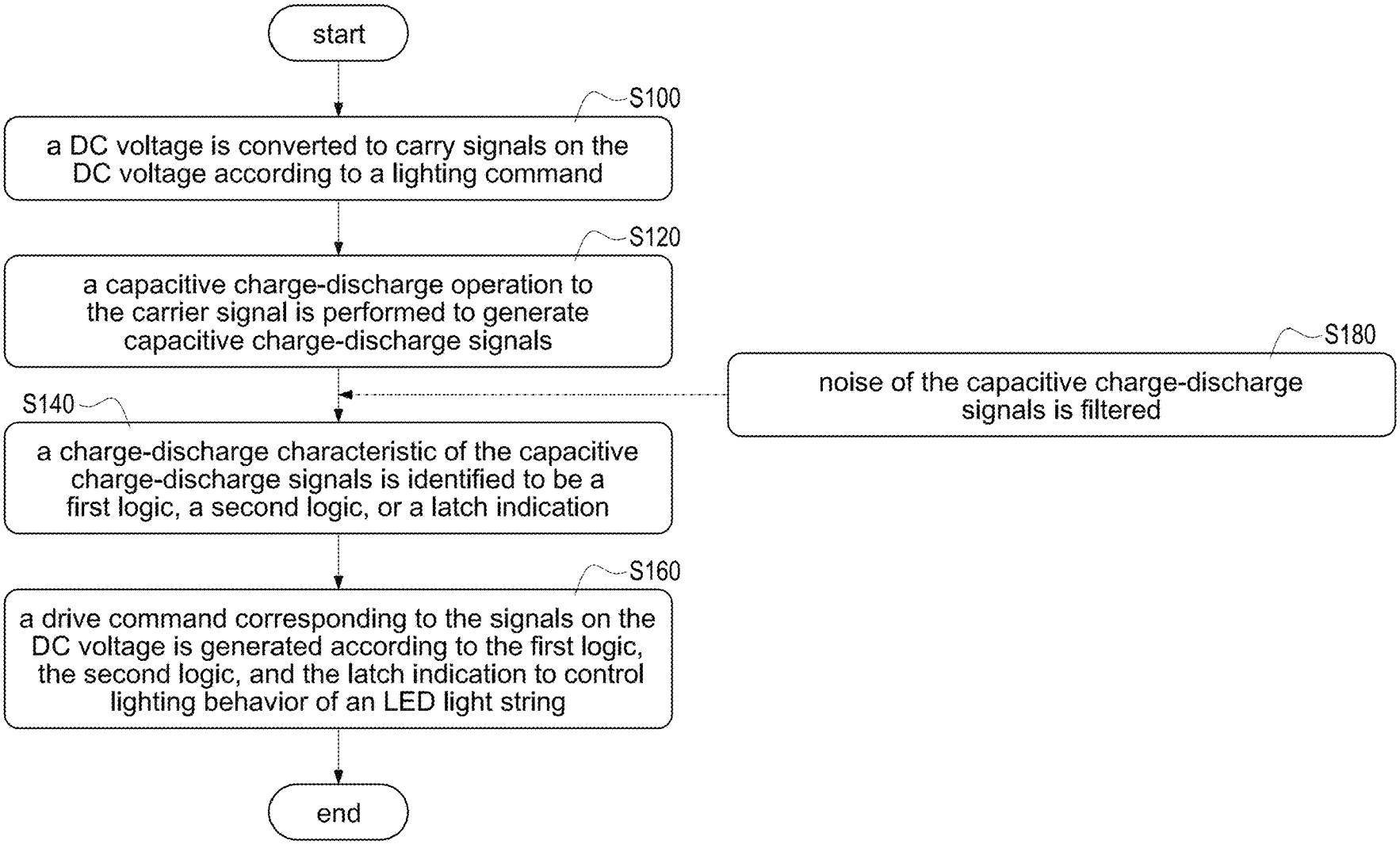
FIG. 4 is a flowchart of a signal identification method of the LED light string control system with carrier identification function according to the present disclosure.

Please refer to FIG. 4, which shows a flowchart of a signal identification method of the LED light string control system with carrier identification function according to the present disclosure, and also refer to FIG. 1 to FIG. 3B. The signal identification method includes steps as follows. First, a DC voltage is converted to carry signals on the DC voltage (hereinafter referred to as carrier signals) according to a lighting command (S100). In one embodiment, a controller 22 provides a control signal Sc to control turning on or turning off a power switch 20 according to the lighting command C1 so that the DC voltage Vdc is converted (switched) to carry signals on the DC voltage (i.e., the carrier signals Scr) by turning on or turning off the power switch 20. Afterward, a capacitive charge-discharge operation to the carrier signals is performed to generate capacitive charge-discharge signals (S120). In one embodiment, a power capacitor C is used to perform the capacitive charge-discharge operation to the carrier signals Scr to generate the capacitive charge-discharge signals Scd. Afterward, a charge-discharge characteristic of the capacitive charge-discharge signals is identified to be a first logic, a second logic, or a latch indication (S140). In one embodiment, an LED module 30 is used to identify the charge-discharge characteristic of the capacitive charge-discharge signals Scd to be the first logic, the second logic, or the latch identification. Specifically, the capacitive charge-discharge signals Scd are detected to generate the logic signal Slg based on the charge-discharge characteristic of the capacitive charge-discharge signals Scd, and then the logic signal Slg is identified by a logic circuit 36 to identify the logic signal Slg to be the first logic, the second logic, or the latch indication.

In particular, the LED module 30 includes at least two manners for identifying the charge-discharge characteristic. The first one is that the LED module 30 uses a predetermined threshold to identify the charge-discharge characteristic, and the second one is that the LED module 30 uses a time width to identify the charge-discharge characteristic. For identifying the charge-discharge characteristic by the predetermined threshold, the capacitive charge-discharge signals Scd are compared with a first threshold V1, a second threshold V2, and a third threshold V3 to correspondingly generate the logic signal Slg. For identifying the charge-discharge characteristic by the time width, the logic signal Slg is correspondingly generated the capacitive charge-discharge signals Scd from being discharged to less than or equal to a predetermined threshold V or being charged to greater than or equal to the predetermined threshold V. Afterward, a drive command corresponding to the signals on the DC voltage is generated according to the first logic, the second logic, and the latch indication to control lighting behavior of the LED light string (S160). In one embodiment, the logic circuit 36 is used to generate the drive command Cd corresponding to the carrier signals Scr according to the first logic, the second logic, and the latch indication. Afterward, a controller 38 is used to store the drive command Cd in a memory unit (not shown) inside the controller 38. Therefore, after all the LED modules 30 in the LED light string 3 have latched the drive commands Cd, the drive commands Cd are used to control lighting behavior of the LED light string 3.

In order to avoid the rough edges or switching surges produced by the capacitive charge-discharge signals Scd from affecting the accuracy of the detection circuit 34 on the capacitive charge-discharge signals Scd, after the step (S120), noise of the capacitive charge-discharge signals is filtered (S180). In one embodiment, a filter circuit 40 is used to filter noise of the capacitive charge-discharge signals Scd to avoid the rough edges or switching surges from affecting the accuracy of the detection circuit 34 on the capacitive charge-discharge signals Scd.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A light-emitting diode (LED) light string control system with carrier identification function, comprising:

a control module configured to convert a DC voltage to carry signals on the DC voltage through a power switch according to a lighting command, a power capacitor coupled to an output end of the control module, and configured to perform a capacitive charge-discharge operation to the signals on the DC voltage to generate capacitive charge-discharge signals, and an LED light string comprising at least one LED module and coupled to the power capacitor; the at least one LED module configured to identify that a charge-discharge characteristic being a first logic, a second logic, or a latch indication, and to generate a drive command corresponding to the signals on the DC voltage according to one of the first logic, the second logic, and the latch identification to control lighting behavior of the LED light string, wherein the at least one LED module generates a logic signal according to the charge-discharge characteristic of the capacitive charge-discharge signals, wherein the at least one LED module uses a predetermined threshold to identify the charge-discharge characteristic, and the at least one LED module compares the capacitive charge-discharge signals with a first threshold, a second threshold, and a third threshold to correspondingly generate the logic signal, and wherein the at least one LED module uses a time width to identify the charge-discharge characteristic, and the at least one LED module correspondingly generates the logic signal according to the capacitive charge-discharge signals from being discharged to less than or equal to a predetermined threshold or being charged to greater than or equal to the predetermined threshold.

2. The LED light string control system as claimed in claim 1, wherein the at least one LED module comprises:

a detection circuit coupled to the power capacitor, and configured to generate the logic signal according to the charge-discharge characteristic of the capacitive charge-discharge signals, a logic circuit coupled to the detection circuit, and configured to identify the charge-discharge characteristic to correspondingly generate the drive command, and a controller coupled to the logic circuit and an LED, and configured to receive the drive command to control the lighting behavior of the LED light string.

3. The LED light string control system as claimed in claim 2, wherein the at least one LED module further comprises:

a filter circuit coupled to the detection circuit, and the filter circuit configured to filter noise of the capacitive charge-discharge signals.

4. The LED light string control system as claimed in claim 1, wherein the drive command comprises at least one of an address data and a lighting data; the address data designates to at least one LED module, and the lighting data designates to the lighting behavior of the at least one LED module.

5. The LED light string control system as claimed in claim 1, wherein the control module comprises:

a power switch coupled to the power capacitor, and the power switch configured to receive the DC voltage, and a controller coupled to the power switch, and the controller configured to receive the lighting command, wherein the controller provides a control signal to control turning on and turning off the power switch according to the lighting command to convert the DC voltage into the signals on the DC voltage.

6. The LED light string control system as claimed in claim 1, wherein the at least one LED module is plural, and the LED modules are coupled in series or coupled in parallel.

7. A signal identification method of a light-emitting diode (LED) light string control system comprising steps of:

converting a DC voltage to carry signals on the DC voltage according to a lighting command, performing a capacitive charge-discharge operation to the signals on the DC voltage to generate capacitive charge-discharge signals, identifying a charge-discharge characteristic of the capacitive charge-discharge signals being a first logic, a second logic, or a latch indication, generating a drive command corresponding to the signals on the DC voltage according to the first logic, the second logic, and the latch indication to control lighting behavior of an LED light string, and generating a logic signal according to the charge-discharge characteristic of the capacitive charge-discharge signals, comparing the capacitive charge-discharge signals with a first threshold, a second threshold, and a third threshold to correspondingly generate the logic signal, or correspondingly generating the logic signal according to the capacitive charge-discharge signals from being discharged to less than or equal to a predetermined threshold or being charged to greater than or equal to the predetermined threshold.

8. The signal identification method as claimed in claim 7, further comprising steps of:

identifying the logic signal being the first logic, the second logic, or the latch indication to correspondingly generate the drive command.

9. The signal identification method as claimed in claim 7, further comprising a step of:

filtering noise of the capacitive charge-discharge signals.

10. The signal identification method as claimed in claim 7, further comprising a step of:

providing a control signal to control turning on or turning off a power switch according to the lighting command to convert the DC voltage to carry signals on the DC voltage.

* * * * *